US007121116B2

(12) United States Patent
Kamoshita et al.

(10) Patent No.: US 7,121,116 B2
(45) Date of Patent: Oct. 17, 2006

(54) METHOD AND DEVICE FOR PRODUCING OXYGEN

(75) Inventors: Tomoyoshi Kamoshita, Kanagawa (JP); Mikihiko Matsuda, Kanagawa (JP); Keishi Ohshima, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 567 days.

(21) Appl. No.: 10/601,887

(22) Filed: Jun. 24, 2003

(65) Prior Publication Data

US 2004/0045315 A1 Mar. 11, 2004

(30) Foreign Application Priority Data

Jul. 1, 2002 (JP) ..... 2002-191673
Jan. 10, 2003 (JP) ..... 2003-004666

(51) Int. Cl.
*F25J 3/00* (2006.01)

(52) U.S. Cl. ..... 62/643

(58) Field of Classification Search ..... 62/6, 62/129, 614, 615, 641, 643
See application file for complete search history.

(56) References Cited

U.S. PATENT DOCUMENTS 5,979,440 A * 11/1999 Honkonen et al. ..... 128/201.21
6,269,658 B1 * 8/2001 Royal et al. ..... 62/643
6,374,617 B1 * 4/2002 Bonaquist et al. ..... 62/6

FOREIGN PATENT DOCUMENTS

| | | |
|---|---|---|
| JP | 63-049223 | 3/1988 |
| JP | 02-116691 | 9/1990 |
| JP | 5-203347 | 8/1993 |
| JP | 11-118349 | 4/1999 |
| JP | 2001-87616 | 4/2001 |
| JP | 2001-304708 | 10/2001 |
| WO | WO 98/58219 | 12/1998 |

* cited by examiner

*Primary Examiner*—Melvin Jones
(74) *Attorney, Agent, or Firm*—Manabu Kanesaka

(57) ABSTRACT

A oxygen-production device includes a pulse-tube cryocooler for cooling air to liquefy oxygen, and a main container for obtaining and retaining liquefied oxygen. The main container has a heat regenerator, a cold head, and a pulse tube of the pulse-tube cryocooler therein. A temperature sensor measures a temperature of the liquefied oxygen, and a control device controls an output of the pulse-tube cryocooler according to the temperature measured by the temperature sensor.

15 Claims, 9 Drawing Sheets

METHOD AND DEVICE FOR PRODUCING OXYGEN

BACKGROUND OF THE INVENTION AND RELATED ART STATEMENT

The invention relates to a method for producing high-purity oxygen used for a medical treatment and the like, and a device for producing high-purity oxygen.

Conventionally, known methods for producing high-purity oxygen include: a method in which oxygen is separated from nitrogen in atmospheric air (hereinafter referred to as "air") using PSA (Pressure Swing Adsorption); a method in which high-purity oxygen is obtained by cooling air using a very low-temperature cooler (cryocooler) and separating the liquid oxygen from other gases such as nitrogen after liquefying the oxygen through a difference between the liquefaction temperature of the oxygen and the liquefaction temperatures of the other gases in the air; and a method in which the oxygen is obtained through a combination of PSA and a cryocooler.

Among these methods, in the method using PSA, when a two-tower system is used, it is difficult to separate oxygen from argon, and therefore a purity of oxygen is limited to 90% to 96%. In order to obtain higher-purity oxygen, it is necessary to use an adsorbent for selectively adsorbing the oxygen to purify the oxygen as disclosed in, for example, Japanese Patent Publication (KOKAI) No. 2001-87616.

The liquefaction temperature of oxygen is −183.0° C. at the atmospheric pressure, whereas the liquefaction temperature of argon is −185.9° C. at the atmospheric pressure. Therefore, in the method using the cryocooler, since the difference in the liquefaction temperatures between the two gases is extremely small, it is very difficult to separate oxygen from argon. To solve this problem, Japanese Patent Publication (KOKAI) No. 05-203347, for example, has disclosed a method in which oxygen and argon are liquefied first, and then the mixture is fractionated to obtain high-purity oxygen.

Incidentally, the cryocoolers, particularly small cryocoolers, have been widely utilized for cooling a variety of devices for detecting a weak-signal as well as for a cryopump, a superconductivity application, and the like. The typical small cryocoolers currently available in the market include two types, namely Stirling cycle and Gifford McMahon cycle. The two types of cryocoolers use helium as a working gas, and generally achieve a temperature range of 150 K-4 K as a targeted temperature. In the Stirling cycle (strictly speaking, it should be called reverse Stirling cycle, but it is often called the Stirling cycle for the cryocooler), a compressor and an expander are used in a refrigeration cycle in which in principle a reverse Carnot cycle is conducted. The cryocoolers are known to be high performance and high efficiency.

Recently, pulse-tube cryocoolers have been developed and expected to replace the conventional cryocooler. The pulse-tube cryocooler does not require a cryogenic moving part (an expander), and is capable of operating by using helium gas. Further, the pulse-tube cryocooler can obtain the temperature range described above. In particular, it is known that the pulse-tube cryocooler with an inertance-tube system provides high refrigeration efficiency by generating variations in gas pressure using a compressor at a frequency near the resonance frequency of a vibration system composed of an inertance tube and a buffer tank (for example, see Japanese Patent Publication (KOKAI) No. 2001-304708).

Recently, there has been an increased demand for oxygen-production device as domiciliary medical equipment. In the domiciliary medical equipment, it is necessary to supply oxygen for an extended period of time when a user of the equipment is out of home. Therefore, it is desired to provide portable medical equipment in which liquefied oxygen is stored in a container.

When a gas with a boiling point lower than that of oxygen is contained at a high concentration, oxygen is easily evaporated at the beginning due to the higher boiling point, thereby obtaining a gas with a high oxygen concentration. However, as time elapses, the amount of the gas other than oxygen having a boiling point lower than that of oxygen increases, thereby reducing the oxygen concentration and causing a risk of oxygen deficiency. For this reason, in the equipment in which liquid oxygen is stored in a container and carried as described above, the law requires that the concentration of oxygen in the container shall be 99.5% or higher.

As described above, in recent years, the demand for the oxygen-production device as the domiciliary medical equipment has increased. More specifically, it has been desired that the oxygen-production device is capable of storing and carrying high-purity oxygen with an oxygen concentration of 99.5% or higher in the container.

In the conventional method of producing oxygen using PSA as disclosed in Japanese Patent Publication No. 2001-87616, it is difficult to obtain oxygen in the required liquid state. In order to obtain liquid oxygen, it is necessary to provide an additional oxygen-liquefying apparatus using the cryocooler, thereby making the system complicated.

In the conventional method of producing liquid oxygen using the conventional cryocooler, due to the extremely small difference between the liquefaction temperatures of oxygen and argon, it is difficult to separate the two gases, thereby making it difficult to obtain high purity liquid oxygen described above. In the method disclosed in Japanese Patent Publication No. 05-203347, it is possible to obtain high purity oxygen gas through the fractionation. However, it is not possible to directly obtain liquid oxygen, which has a boiling point higher than that of argon.

In view of the problems described above, the invention has been made, and an object of the invention is to provide a method and a device for producing liquid oxygen with an oxygen concentration of 99.5% or higher directly and with high efficiency in which oxygen in the air is effectively separated from nitrogen and argon.

Further objects and advantages of the invention will be apparent from the following description of the invention.

SUMMARY OF THE INVENTION

In order to attain the objects described above, according to the first aspect of the invention, a method for producing oxygen comprises a step in which a cryocooler cools air to a temperature not higher than the liquefaction temperature of oxygen and not lower than the liquefaction temperature of argon, thereby allowing nitrogen and argon in a vapor phase to be separated from liquefied oxygen, or allowing argon in a vapor phase to be separated from liquefied oxygen. With this method, it is possible to obtain high-purity liquid oxygen directly and with high efficiency.

According to the invention, the following aspects are preferable. According to the second aspect of the invention, in the method in the first aspect, the method for producing oxygen further comprises a step in which air introduced from outside to a cooling part of the cryocooler is cooled preliminarily through heat exchange between air and a low-temperature gas including separated nitrogen and argon. Further, moisture in the introduced air may be removed in advance.

According to the third aspect of the invention, in the method in the first and second aspects, the method for producing oxygen further comprises a step in which nitrogen in air is removed in advance to introduce an oxygen-rich gas into the cooling part of the cryocooler. With the methods in the second and third aspects of the invention, it is possible to improve energy efficiency for liquefying oxygen. Further, the moisture in the introduced air is removed in advance, thereby preventing the moisture in air from freezing and adhering to the cooling part of the cryocooler.

According to the fourth aspect of the invention, in the method in any of the first to third aspects, it is arranged to measure a temperature of the liquefied oxygen and control an output of the cryocooler to maintain the temperature at a predetermined value. Also, according to the fifth aspect of the invention, in the method in the fourth aspect, it is arranged to measure the temperature of the liquefied oxygen through heat-transfer means immersed in the liquefied oxygen.

Further, according to the sixth aspect of the invention, in the method in any of the first to fourth aspects, the cryocooler is a pulse-tube cryocooler. In the method in any of the fourth to sixth aspects, it is possible to control effectively to liquefy oxygen with high freezing efficiency.

According to the seventh aspect of the invention, to perform the methods described above, an oxygen-production device comprises: a pulse-tube cryocooler for cooling air to liquefy oxygen; a container for obtaining and retaining liquefied oxygen including an air inlet, an output port for the liquefied oxygen, an outlet for residual gas other than the liquefied oxygen, a heat regenerator of the pulse-tube cryocooler, a cold head thereof, and a pulse tube thereof; a temperature sensor for measuring a temperature of the liquefied oxygen; and a control device for controlling an output of the pulse-tube cryocooler according to the temperature measured by the temperature sensor.

According to the eighth aspect of the invention, in the production device in the seventh aspect, instead of the container, a production device includes the first container having the heat regenerator of the pulse-tube cryocooler, the cold head thereof, and the pulse tube thereof; and the second container disposed in the first container for obtaining and retaining the liquefied oxygen as a liquid storage tank having the temperature sensor. The production device further comprises a heat exchanger thermally connected to the cold head, so that air is introduced into the heat exchanger and cooled to flow into the liquid storage tank. In the liquid storage tank, the liquefied oxygen is separated from nitrogen gas and argon gas to obtain the liquid oxygen with a high purity.

According to the ninth aspect of the invention, in the production device in the eighth aspect, the production device includes a liquid storage tank thermally connected to the cold head instead of the heat exchanger and the liquid storage tank. Also, according to the tenth aspect of the invention, in the production device in the ninth aspect, the liquid storage tank is provided with a radiator member thermally connected to the cold head.

According to the eleventh aspect of the invention, in the production device in the seventh aspect, the production device includes a heat exchanger for preliminary cooling air introduced into the container through heat exchange between the introduced air and a low-temperature gas including nitrogen and argon separated in the container. According to the twelfth aspect of the invention, in the production device in the seventh aspect, the production device includes a dehumidifier for removing moisture from air introduced into the container by utilizing cold heat of the low-temperature gas including nitrogen and argon separated in the container.

According to the thirteenth aspect of the invention, in the production device in the twelfth aspect, the dehumidifier includes a body container (main housing) having an air introduction pipe; a low-temperature gas pipe with a radiation fin that passes though the body container; and a selector valve arranged below the body container for switching air and condensed water.

According to the fourteenth aspect of the invention, in the production device in the thirteenth aspect, the body container of the humidifier is provided with an adsorbent for adsorbing the moisture in the body container.

According to the fifteenth aspect of the invention, in the production device in the thirteenth aspect, the production device includes two sets of dehumidifiers each having the air introduction pipe, the low-temperature gas introduction/lead-out pipe, and the selector valve. It is configured that when the air flowing through one of the dehumidifiers is introduced into the container to liquefy oxygen, air flowing through the other of the dehumidifiers transfers condensed water inside the body container to the outside together with air via the selector valve.

According to the sixteenth aspect of the invention, in the production device in the fifteenth aspect, instead of the two sets of the dehumidifiers each having the air introduction pipe, the low-temperature gas introduction/lead-out pipe, and the selector valve, one of the two dehumidifiers has the low-temperature gas lead-out pipe connected to the other of the dehumidifiers. The air introduction pipe is provided with an air selector valve so that condensed water in one of the body containers is exhausted to the outside with the low-temperature gas from the other body container through the selector valve.

DETAILED DESCRIPTION OF PREFERRED EMBODIMENTS

Hereunder, preferred embodiments of the present invention will be described with reference to the accompanying drawings.

Figure 1:
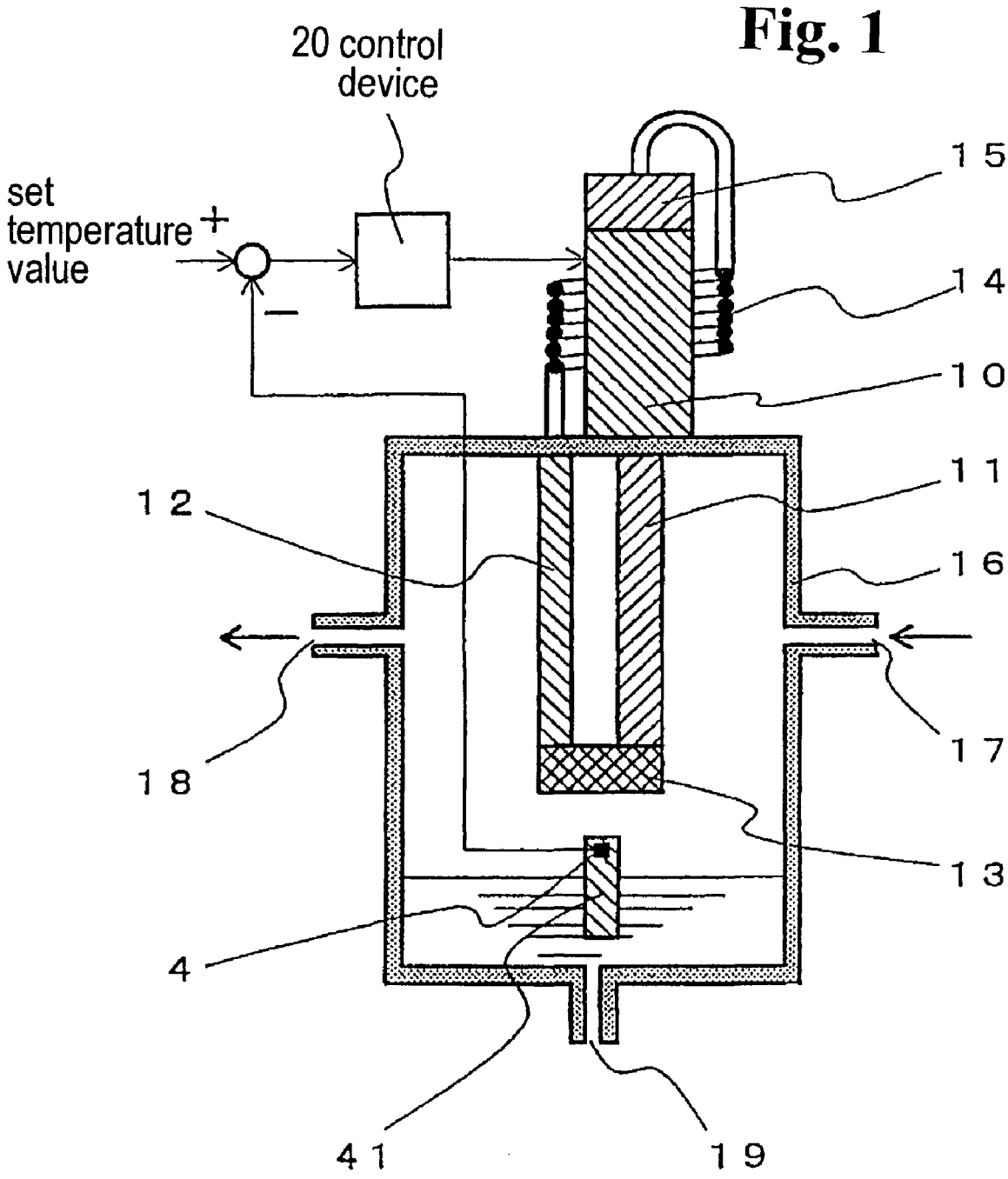
FIG. 1 is a view schematically showing a configuration of an oxygen-production device according to the present invention.

FIG. 1 is a view schematically showing a configuration of an oxygen-production device according to the present invention. According to this embodiment, a production device is provided with a pulse-tube cryocooler, i.e. a Stirling-cycle cryocooler, more specifically a pulse-tube cryocooler of an inertance-tube system, for cooling air to produce high-purity oxygen.

As shown in FIG. 1, the pulse-tube cryocooler is composed of a compressor 10, a heat regenerator 11, a pulse tube 12, a cold head 13, an inertance tube 14, and a buffer tank 15. One end of the heat regenerator 11 penetrates an upper surface of a container 16 and is connected to the compressor 10. One end of the pulse tube 12 penetrates the upper face of the container 16 and is connected to one end of the inertance tube 14. The other end of the inertance tube 14 is connected to the buffer tank 15.

The compressor 10 is provided with a piston and a linear motor for driving the piston (not shown). The piston reciprocates when a control device 20 applies a 50 Hz AC voltage to the linear motor, so that the cold head 13 is cooled through compression and expansion of helium gas as a working fluid. The control device 20 controls the voltage applied to the linear motor to maintain cooling output of the cryocooler at a predetermined value.

The container 16 is formed in a heat-insulating structure such as a vacuum bottle, so that an interior space is thermally insulated and kept airtight from the ambient atmosphere. The container 16 is provided with a gas inlet 17, a gas outlet 18, and a liquid-oxygen output port 19.

In this configuration, when the cryocooler starts and air is introduced from the gas inlet 17 into the interior space of the container 16, air in the interior space of the container 16 is cooled as the temperature of the cold head 13 is decreased. At this time, the cryocooler is operated so that the temperature measured by a temperature sensor 4 is maintained at a predetermined temperature equal to or lower than the liquefaction temperature of oxygen, −183.0° C., and equal to or higher than the liquefaction temperature of argon, −185.9° C. Accordingly, oxygen in air starts to be liquefied when the temperature of air reaches the liquefaction temperature of oxygen of −183.0° C. The control device 20 controls the cryocooler to maintain the temperature at the predetermined value once the temperature reaches the predetermined value.

In this state, when a blower (not shown) starts to supply air from the gas inlet 17, the cryocooler is controlled so that the temperature measured by the temperature sensor 4 is maintained at the predetermined value, and oxygen in the supplied air is liquefied. Nitrogen gas and argon gas in the air are discharged from the gas outlet 18 in accordance with an amount of the supplied air.

In general, air supplied from the gas inlet 17 generates convection of a gas at the interior space of the container 16. In a case that the temperature sensor 4 is disposed in, for example, the cold head 13, and the cryocooler is controlled so that the measured temperature thereof becomes equal to the predetermined value, a part of the produced liquid oxygen contacts air and vaporizes, and is discharged from the gas outlet 18. Therefore, it is possible that a yield of producing oxygen lowers and an amount of cold heat exhausted to the outside increases, thereby reducing efficiency.

In the embodiment, as shown in FIG. 1, the temperature sensor 4 is disposed in heat-transferal means 41 immersed in the liquid oxygen, and the cryocooler is controlled to maintain the temperature measured by the temperature sensor 4 at the predetermined value. In the initial stage of the operation in which the liquid oxygen is produced in a small quantity, the temperature sensor 4 is positioned at a level above a surface of the liquid oxygen and exposed to air. Accordingly, the temperature sensor 4 may detect a higher temperature due to heat conduction from high-temperature air in the space, thereby increasing the output of the cryocooler. As a result, it is possible that nitrogen and argon are partially liquefied due to the increased cooling output.

As the cryocooler keeps operating and the level of the liquid oxygen, in some cases including liquefied nitrogen and the like for the above-described reason, rises, the temperature sensor 4 is immersed in the liquid oxygen. As a result, the temperature sensor 4 measures the liquid temperature of the liquid oxygen, and the cryocooler is controlled to maintain the temperature at the predetermined value. Even if the cooling output increases in the initial stage of the operation, and liquid nitrogen and liquid argon are contained in the liquid oxygen, since the cooling output decreases to a proper value at this stage, the liquid nitrogen and liquid argon are removed from the liquid oxygen, thereby obtaining the high-purity liquid oxygen.

With the configuration of the embodiment, the temperature of the liquid oxygen is measured, and the cryocooler is controlled to maintain the temperature at the predetermined value. Therefore, it is possible to control in a way suitable for producing the high-purity oxygen. Further, in the embodiment, the heat-transferal means 41 is used to measure the temperature of the liquid oxygen even when the level of the liquid oxygen is low. Therefore, it is possible to reduce an increase in the cooling output at the initial stage of the operation, thereby being suitable for producing high-purity oxygen.

Figure 2:
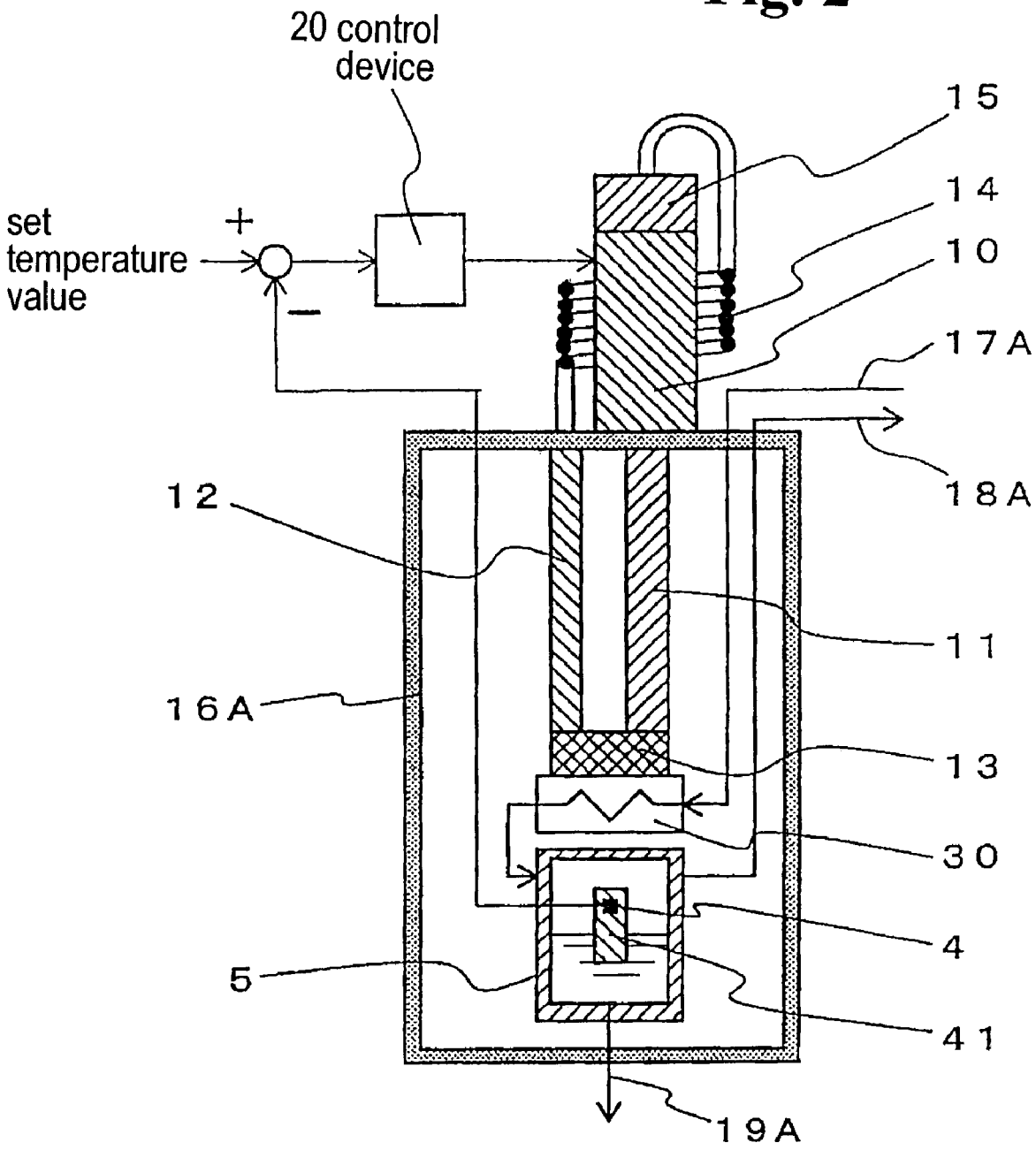
FIG. 2 is a view schematically showing a configuration of another oxygen-production device according to the present invention.

FIG. 2 is a view showing a configuration of an oxygen-production device according to the second embodiment of the invention. Similar to the first embodiment, the device of this embodiment also cools air using a pulse-tube cryocooler, i.e. a Stirling-cycle cryocooler, to produce high-purity oxygen. Different from the first embodiment, the device of the second embodiment is arranged such that a heat exchanger 30 is attached to the cold head 13 disposed inside a container 16A, and air cooled by the heat exchanger 30 is guided to a liquid storage tank 5 installed in the container 16A.

In this configuration, after air guided from a gas inlet 17A is cooled though heat exchange in the heat exchanger 30, air is subsequently guided to the liquid storage tank 5, and liquefied oxygen is stored in the liquid storage tank 5. The gas including nitrogen gas, argon gas, and the like is exhausted from a gas outlet 18A to the outside.

In the structure of the embodiment, the liquid oxygen stored in the liquid storage tank 5 is isolated from the ambient gas in the interior space of the container 16A. Therefore, an amount of heat conduction due to convection of the ambient gas contacting the regenerator 11 and a high-temperature side of the pulse tube 12 is limited, and the efficiency of the system is thereby improved.

In the first embodiment, the container 16 is formed in the heat-insulating container such as a vacuum bottle, so that the interior space is thermally insulated from the ambient atmosphere. In the second embodiment shown in FIG. 2, the interior space of the container 16A is maintained in a vacuum state. Thus, the container 16A may be formed in a simple airtight container, and it is unnecessary to make the container a heat-insulating structure. Because the interior space of the container 16A is maintained in a vacuum state as described above, it is possible to reduce the amount of heat penetrating into the liquid storage tank 5, thereby producing oxygen efficiently.

Figure 3:
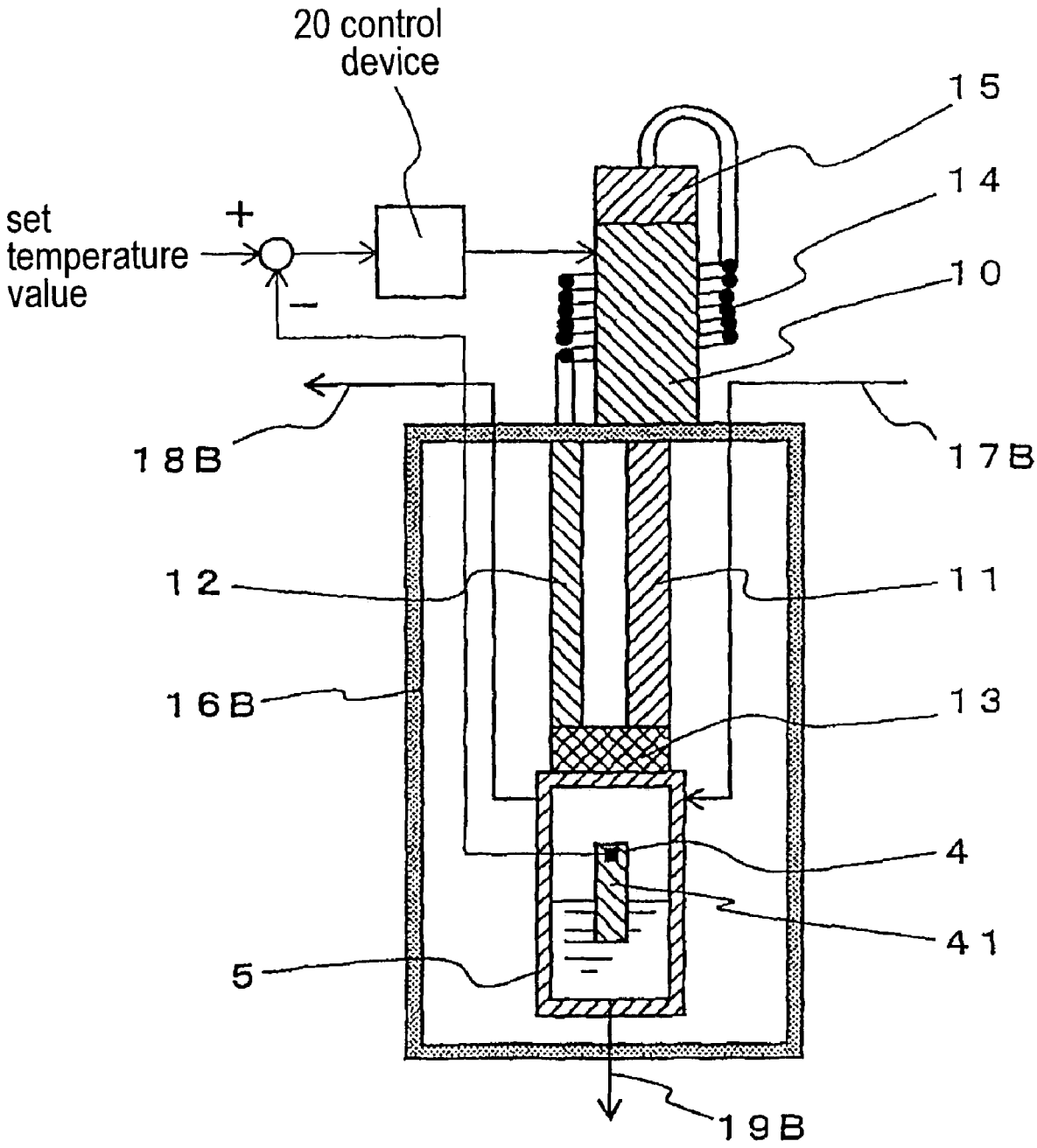
FIG. 3 is a view schematically showing a configuration of another oxygen-production device according to the present invention.

FIG. 3 is a view showing a configuration of an oxygen-production device according to the third embodiment of the invention. In the production device of this embodiment, the liquid storage tank 5 is thermally integrated with the cold head 13, and is disposed inside a container 16B. In this configuration, air introduced from a gas inlet 17B is cooled in the liquid storage tank 5 thermally integrated with the cold head 13 to liquefy oxygen, and liquid oxygen is stored in the liquid storage tank 5. A gas such as nitrogen is discharged from a gas outlet 18B to the outside.

In the configuration, the liquefied oxygen is thermally insulated effectively as in the second embodiment, thereby producing high-purity oxygen efficiently.

Figure 4:
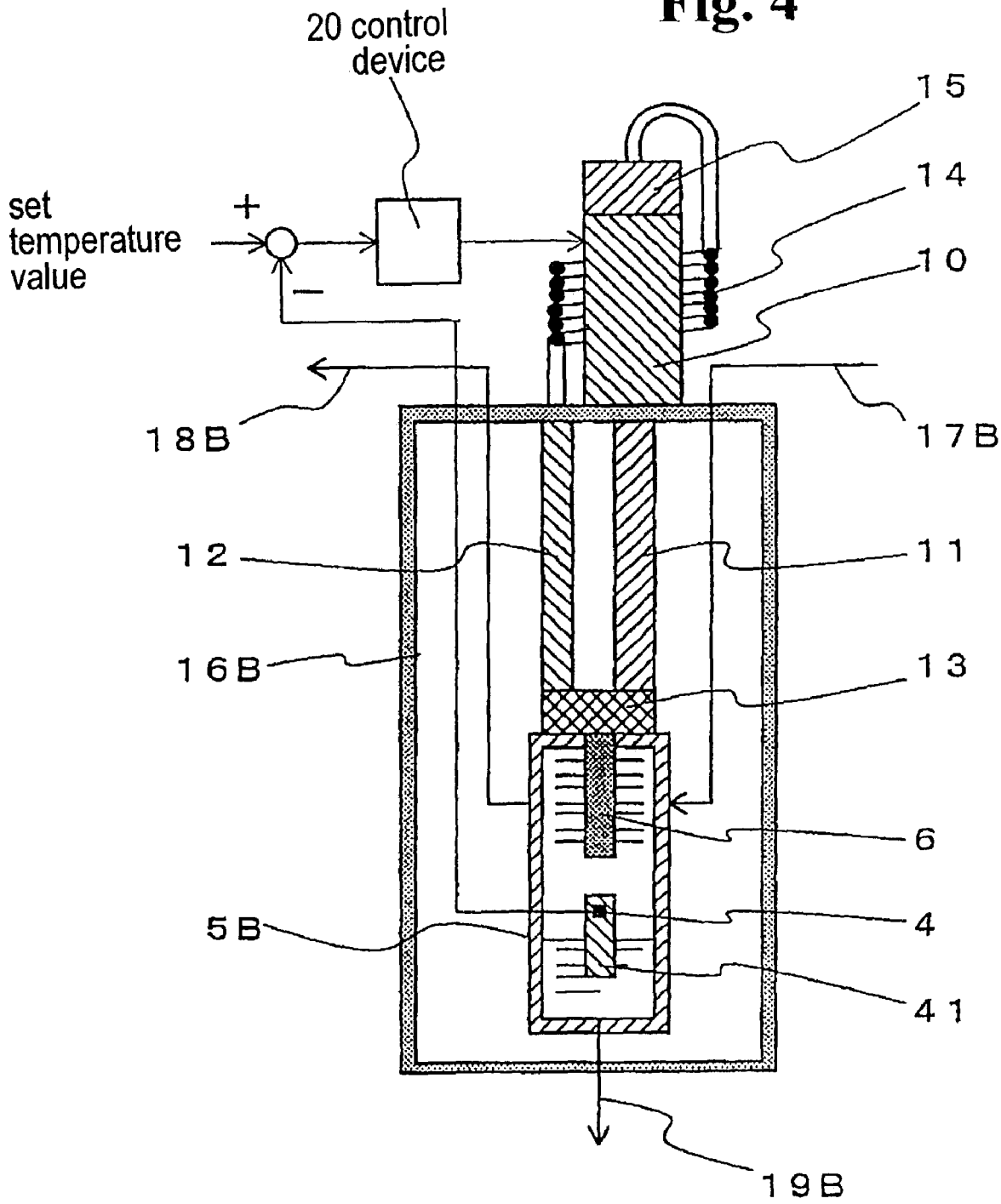
FIG. 4 is a view schematically showing a configuration of another oxygen-production device according to the present invention.

FIG. 4 is a view showing a configuration of an oxygen-production device according to the fourth embodiment of the invention. In the production device, a radiator member 6 is thermally connected to the cold head 13, and is disposed inside a liquid storage tank 5B thermally integrated with the cold head 13. With this configuration, air introduced into the interior of the liquid storage tank 5B is liquefied efficiently through effective heat exchange with the radiator member 6. Accordingly, the configuration is suitable for an oxygen-production device with a large capacity.

Figure 5:
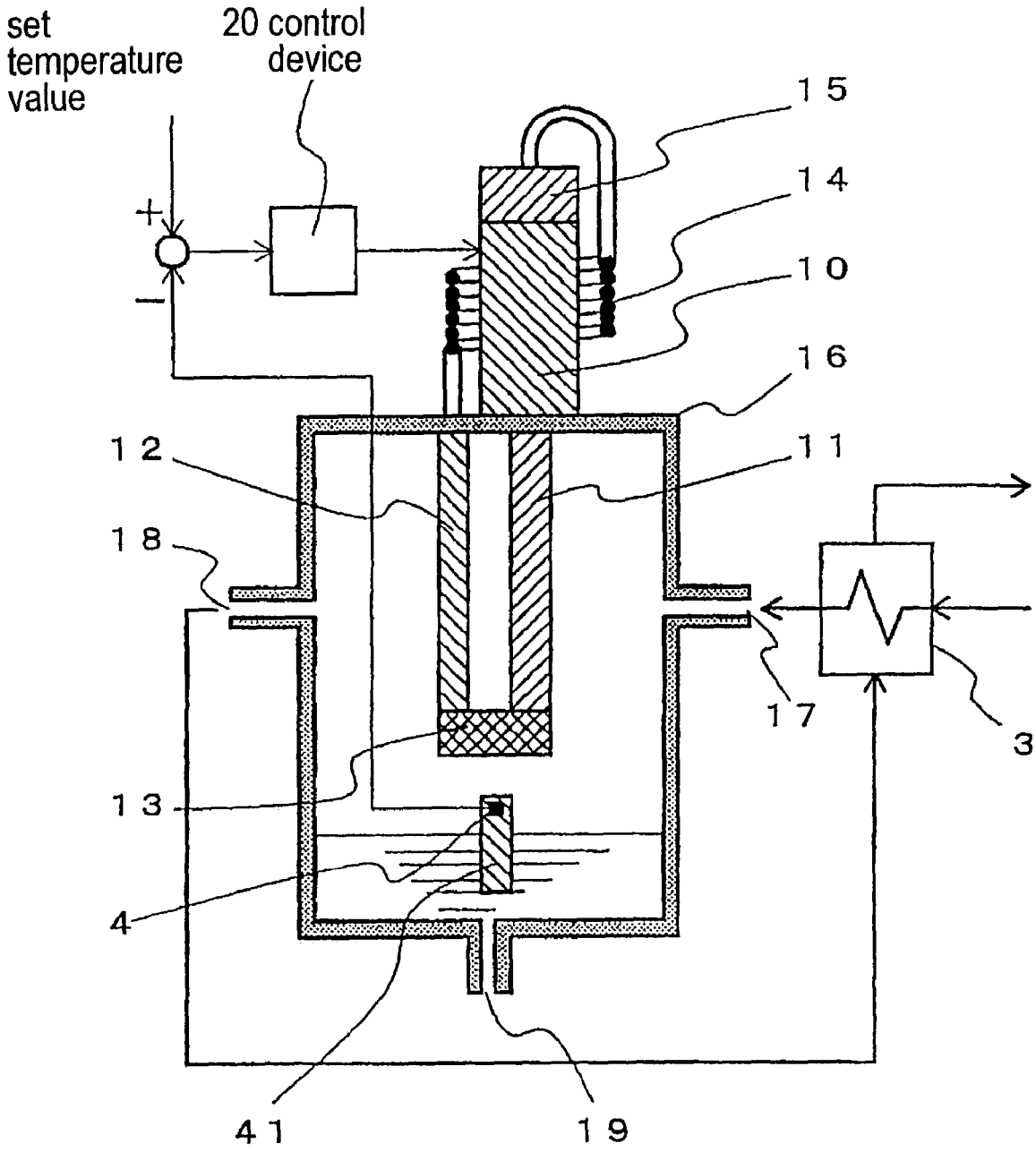
FIG. 5 is a view schematically showing a configuration of another oxygen-production device according to the present invention.

FIG. 5 is a view showing a configuration of an oxygen-production device according to the fifth embodiment of the invention. In this configuration, a heat exchanger 3 is disposed in a supply system of air introduced from the gas inlet 17 of the container 16. Air is cooled in advance through heat exchange between air and a low-temperature gas discharged from the gas outlet 18. As a result, the required cooling output of the cryocooler is significantly reduced, as shown in the following calculations.

That is, as an example for the calculations, an oxyecoia supply device for the domiciliary treatment is capable of supplying 2 l/min of oxygen. This supply rate is equal to an oxygen supply rate of 0.12 $m^3$/h, and it is necessary to introduce air at a rate of 0.6 $m^3$/h to liquefy the oxygen therein. In the methods of the first embodiment through the fourth embodiment described above, when air is cooled from the normal temperature 20° C. to, for example, the liquefaction temperature of the oxygen −183° C. at a rate of approximately 0.6 $m^3$/h, it is necessary to remove 8.9 W of heat for oxygen (flow rate: 0.12 $m^3$/h; specific heat at constant pressure: 0.92 J/g/K; density: 1.43 kg/m3), and 35.2 W of heat for nitrogen (flow rate: 0.48 $m^3$/h; specific heat at constant pressure: 1.04 J/g/K; density: 1.25 kg/m3). Further, it is necessary to remove 10.0 W of heat to condense oxygen (condensation heat: 210 J/g). Therefore, a total 54.1 W of heat needs to be removed. Therefore, with the cryocooler having 3% efficiency, approximately 1.8 kW of power is required.

On the contrary, in the case that the oxygen-production device shown in FIG. 5 produces oxygen at a rate of 0.12 $m^3$/h, air introduced from the gas inlet 17 is cooled effectively in the heat exchanger 3 by the low-temperature nitrogen gas discharged from the gas outlet 18. Assuming that the nitrogen gas discharged from the heat exchanger 3 has a temperature 5° C., the heat capacity of nitrogen between the liquefaction temperature of oxygen and 5° C. is utilized to cool air introduced into the heat exchanger 3. As a result, it is necessary to remove 32.6 W less heat for the cooling, i.e. 11.5 W of heat needs to be removed to cool air to the liquefaction temperature at the rate of 0.6 $m^3$/h. Therefore, the required cooling-power output becomes 21.5 W and the required power is approximately 720 W with the cryocooler of 3% efficiency. This value corresponds to approximately 40% of the required power for the production methods without using the heat exchanger 3, indicating that the heat exchanger 3 drastically reduces the required power.

In the fifth embodiment, the heat exchanger 3 is disposed in the supply system of the oxygen-production device shown in FIG. 1 as described above. It is apparent without an example that the required power is reduced drastically when the heat exchanger 3 is disposed in the supply system of any of the oxygen-production devices shown in FIGS. 2, 3, and 4.

Figure 6:
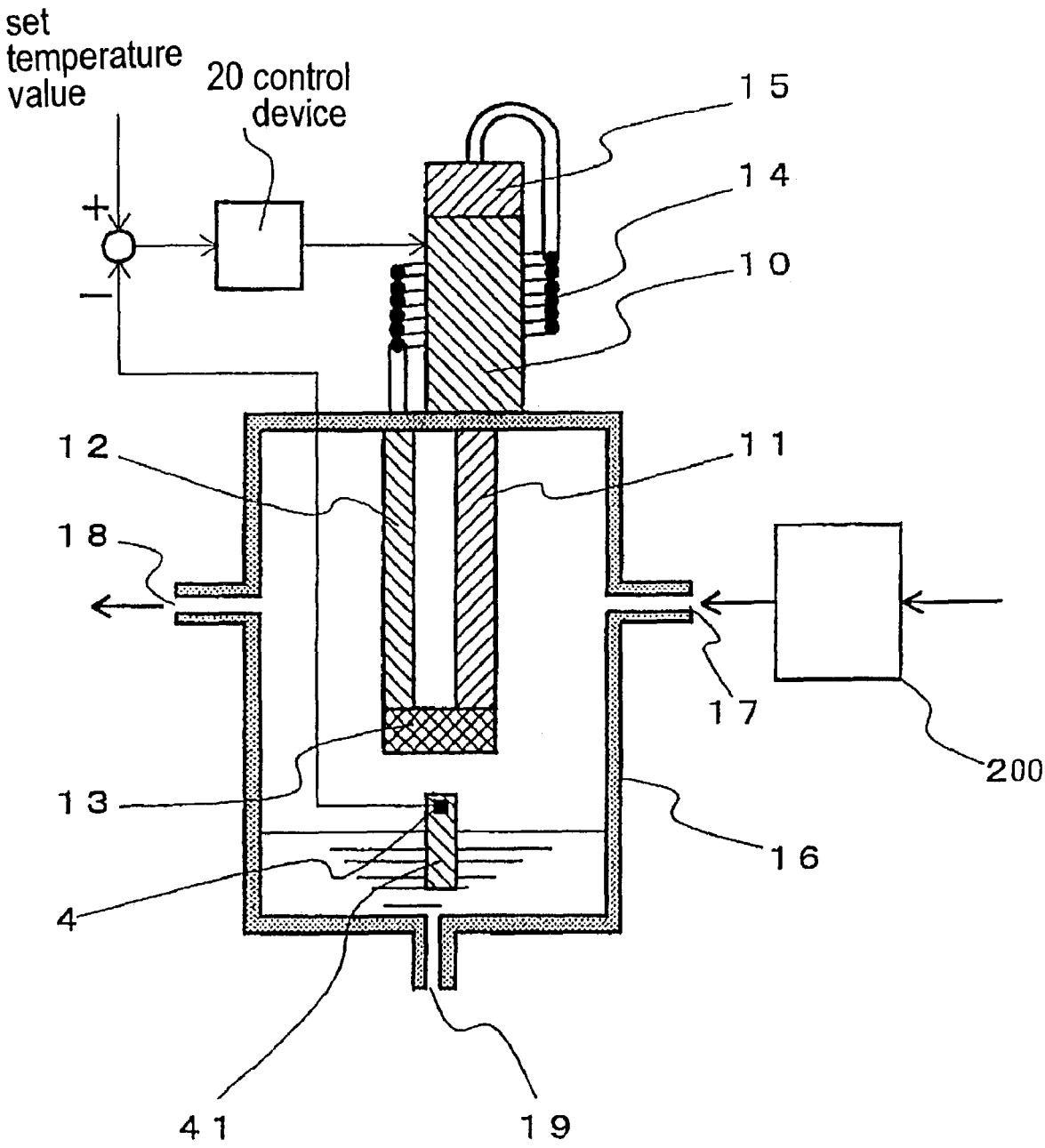
FIG. 6 is a view schematically showing a configuration of another oxygen-production device according to the present invention.

FIG. 6 is a view showing a configuration of an oxygen-production device according to the sixth embodiment of the invention. In the production device, a PSA 200 is disposed in the supply system of air introduced from the gas inlet 17 of the container 16. The PSA 200 separates oxygen from nitrogen, and oxygen is introduced into the container 16. Oxygen is cooled and liquefied in order to further separate argon, thereby obtaining high-purity oxygen.

When this configuration is applied to an oxyecoia supply device for the domiciliary treatment capable of supplying oxygen at a rate of 2 l/min, the cryocooler needs to cool oxygen to the liquefaction temperature at a rate of 0.12 $m^3$/h. Accordingly, the required quantity of heat removal is 18.9 W, i.e. 8.9 W for cooling and 10.0 W for condensation, and the total required power is 630 W using the cryocooler with 3% efficiency. Since approximately 20 W of power required for the PSA to obtain the oxygen at the rate of 0.12 $m^3$/h, the total power consumption of the device is 650 W, i.e. 70 W less than that of the device in the fifth embodiment.

In the sixth embodiment, the PSA200 is disposed in the air-supply system of the oxygen-production device shown in FIG. 1. Alternatively, the PSA200 may be disposed in the air-supply system of the oxygen-production device of any of the devices shown in FIGS. 2, 3, 4, and 5.

Figure 7:
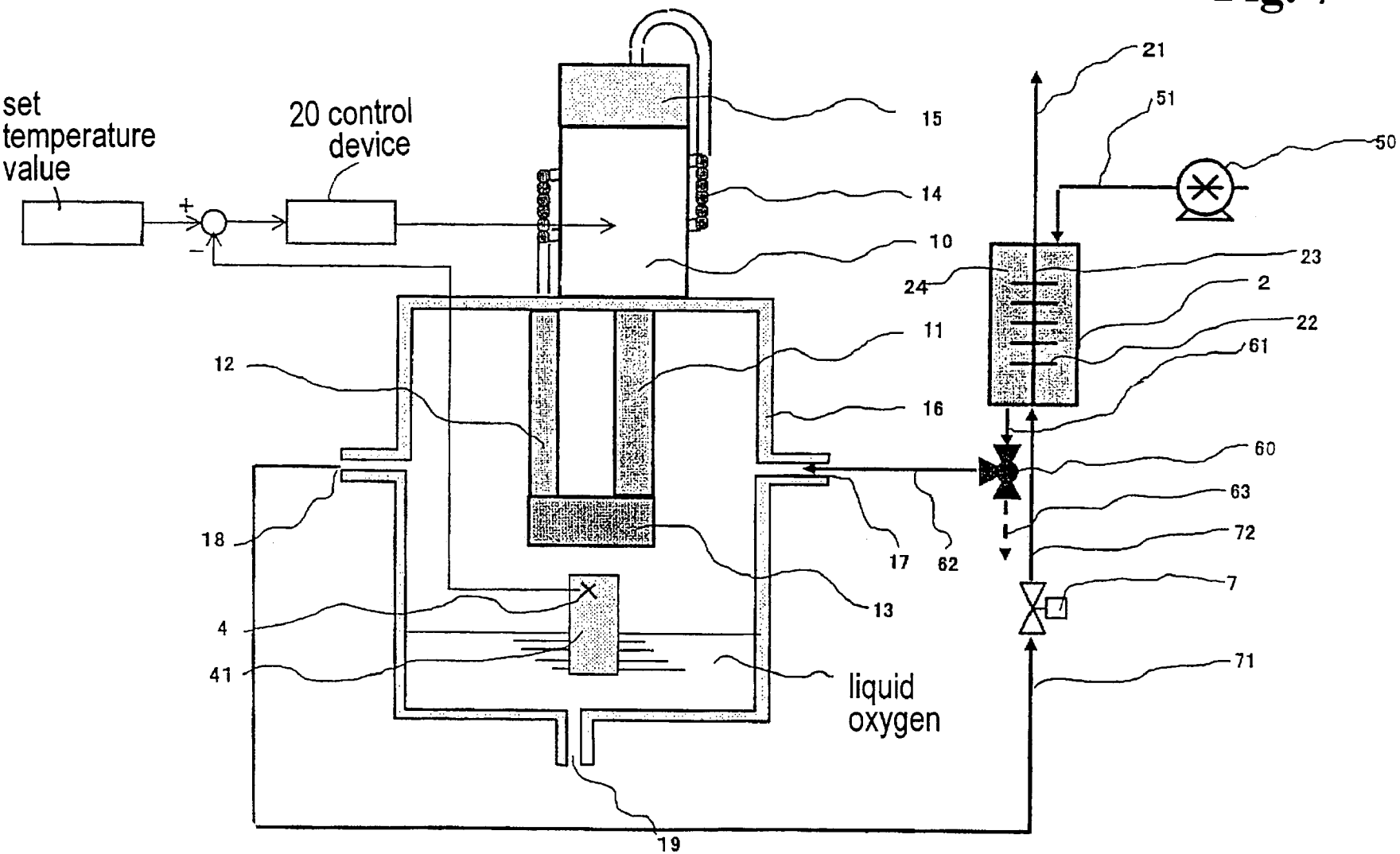
FIG. 7 is a view schematically showing a configuration of another oxygen-production device according to the present invention.

FIG. 7 is a view showing a configuration of an oxygen-production device according to the seventh embodiment of the invention. In this production device, a dehumidifier 2 is disposed in the supply system of air in the oxygen-production device shown in FIG. 1. The dehumidifier 2 is composed of a body container (main housing) 24 having an air introduction pipe, a low-temperature gas pipe 23 with a radiation fin 22 passing through the body container, and a selector valve 60 arranged below the body container for switching air and condensed water.

In FIG. 7, when a blower 50 supplies air to the dehumidifier 2, moisture in air is removed in principle described later. Dried air is supplied to the gas inlet 17 from a selector-valve inlet pipe 61 through a selector-valve outlet pipe 62 connected to an exit of the selector valve 60. The control device 20 controls the cryocooler to maintain a temperature of the dried air measured by the temperature sensor 4 at a predetermined value, so that the dried air supplied to the container 16 is cooled and liquefied.

Nitrogen gas and argon gas are cooled and separated from oxygen, and are discharged from an exhaust pipe 21 according to the flow rate of the supplied air, after flowing through a shutoff-valve inlet pipe 71 from the gas outlet 18 and further flowing through the dehumidifier 2 from a shutoff-valve outlet pipe 72 connected to a shutoff valve 7 in an open state. According to this embodiment, the dehumidifier 2 removes moisture in the introduced air in advance. Therefore, it is possible to prevent the moisture in air from being frozen and adhering to the cooling part of the cryocooler.

In any of the first through sixth embodiments, it is necessary to dehumidify introduced air using, for example, an adsorbent (not shown in the figure) or the like. On the other hand, according to the embodiment shown in FIG. 7, it is possible to dehumidify the introduced air effectively and economically utilizing cold heat of the exhaust gas accompanying the production of oxygen.

Next, the principle of removing the moisture by the dehumidifier 2 will be described. As described above, the dehumidifier 2 is provided with the low-temperature gas pipe 23 with the radiation fin 22 in the body container 24, and has a similar construction to that of a fin-tube-type heat radiator. When air is supplied into the body container 24 of the dehumidifier 2, the supplied air contacts the radiation fin 22. At the same time, nitrogen gas and argon gas cooled and separated from oxygen are flowing through the low-temperature-gas pipe 23. The radiation fin 22 is cooled by the gases, and the moisture in air condenses on a surface of the fin. The radiation fin 22 captures the moisture through a reduction in the temperature of air contacting the cooled radiation fin 22, thereby removing the moisture from air.

While the dehumidifier 2 has the fin-tube-type heat exchanger in this embodiment, a plate-type heat exchanger may be used, and the invention is not limited to the embodiment.

As a preferable example, an adsorbent such as zeolite may be charged into an interior space of the body container 24 of the dehumidifier 2, so that the moisture is removed efficiently utilizing the low-temperature-adsorption effect of the absorbent.

In the seventh embodiment, the dehumidifier 2 is connected to the selector valve 60 and the shutoff valve 7. These valves are provided for discharging the moisture captured by the dehumidifier 2 periodically to recover the moisture-removal capacity of the dehumidifier 2. This is because when the dehumidifier 2 captures an excess amount of the moisture, the capacity of the humidifier 2 decreases. The selector valve 60 switches to the purge-pipe side periodically and the shutoff valve 7 is closed. Accordingly, air introduced from the blower 50 is discharged to the outside directly from a purge pipe 63 without being introduced into the container 16. As a result, the low-temperature gas including cooled nitrogen gas, etc. does not flow in the low-temperature gas pipe 23 in the dehumidifier 2. In this state, air supplied into the dehumidifier 2 has a temperature higher than that of the fin and heats the fin, thereby evaporating the condensed moisture to be exhausted together with air. Similarly, in the preferable example using the absorbent described above, air heats the adsorbent to evaporate the moisture adsorbed in the adsorbent. The moisture is exhausted with air, and the adsorbent is dried, thereby recovering the capacity of the dehumidifier 2.

Figure 8:
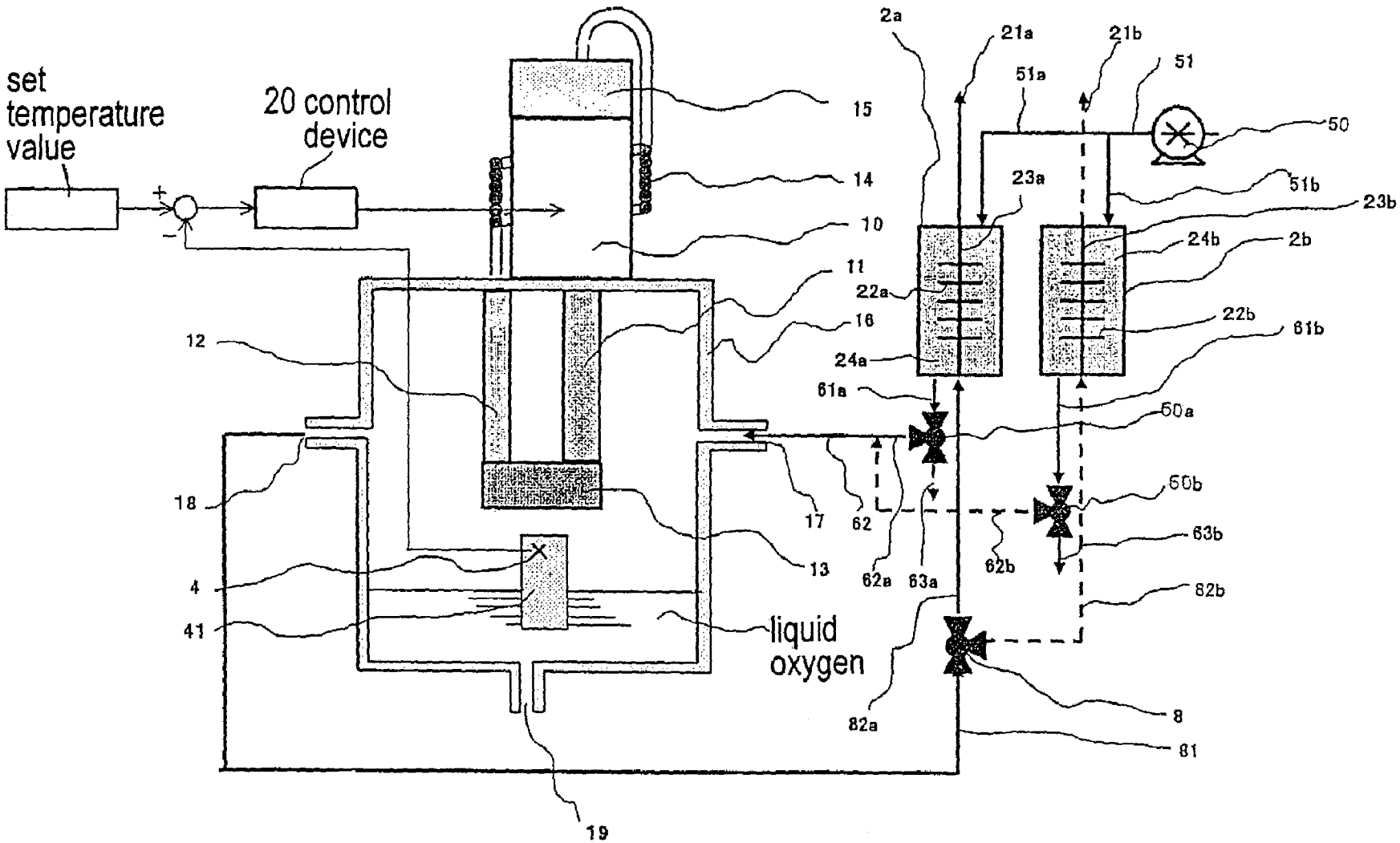
FIG. 8 is a view schematically showing a configuration of another oxygen-production device according to the present invention.

FIG. 8 is a schematic view showing a configuration of an oxygen-production device improved from the embodiment shown in FIG. 7 according to the eighth embodiment of the invention. In the embodiment shown in FIG. 7, in order to recover the capacity of the dehumidifier 2, it is necessary to interrupt the liquefaction of the oxygen periodically. In the embodiment shown in FIG. 8, two sets of dehumidifiers are provided so that oxygen is liquefied continuously without interruption. The two dehumidifiers (2*a*, 2*b*) operate alternately in the way described above with reference to FIG. 7.

That is, when air flowing through one of the dehumidifiers is guided to the container 16 and oxygen therein is liquefied, the other of the dehumidifiers removes the moisture captured by the dehumidifier, so that oxygen is liquefied continuously. Note that in FIG. 8, members having the same function, such as the two sets of the dehumidifiers, are denoted by the same reference numeral with suffixes, a and b, respectively. A selector valve 8 is provided in place of the shutoff valve 7 shown in FIG. 7, and a selector-valve inlet pipe 81 and selector-valve outlet pipes 82*a*, 82*b* are connected thereto. Hidden lines in the figure indicate the pipes through which the fluid does not flow, and solid lines indicate the pipes through which the fluid flows.

Figure 9:
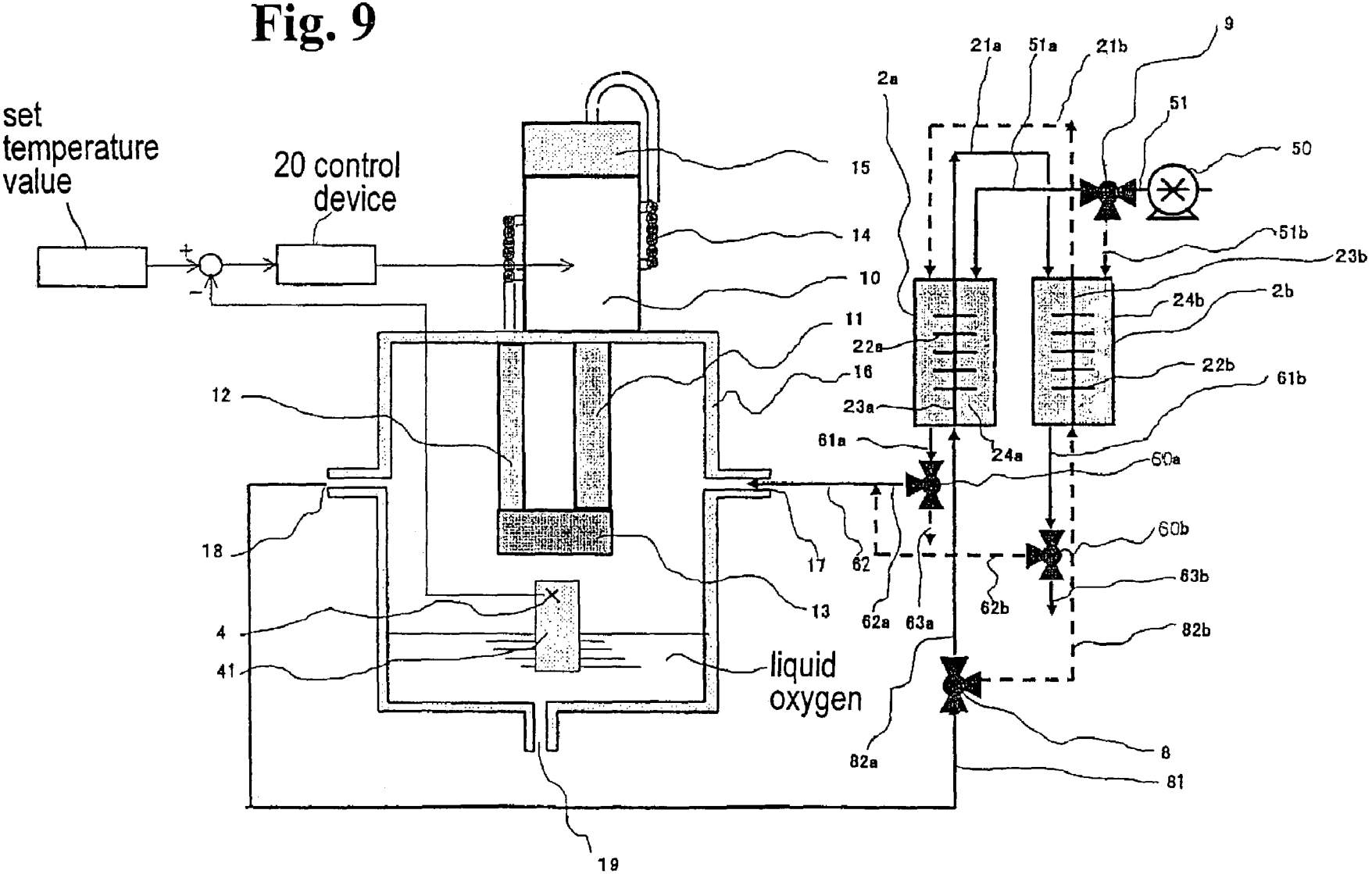
FIG. 9 is a view schematically showing a configuration of another oxygen-production device according to the present invention.

According to the ninth embodiment of the invention, FIG. 9 is a schematic view showing a configuration of an oxygen-production device improved from the embodiment shown in FIG. 8. In this embodiment, different from the eighth embodiment shown in FIG. 8, an air selector valve 9 is disposed between the blower 50 and dehumidifiers 2*a*, 2*b*, and exhaust pipes 21*a*, 21*b* are connected to the dehumidifiers 2*b*, 2*a*, respectively. With the configuration, when the moisture captured by the dehumidifier is discharged, nitrogen gas and argon gas having dew points lower than outside air and separated from oxygen are exhausted to the outside through the dehumidifier. Therefore, it is possible to restore the capacity of the dehumidifier faster than the method in which the outside air is used.

As described above, according to the invention, the oxygen-production device comprises: the pulse-tube cryocooler for cooling air to liquefy oxygen; the container for obtaining and retaining the liquefied oxygen including the air inlet, the output port for the liquefied oxygen, the outlet for the residual gas other than the liquefied oxygen, the heat regenerator of the pulse-tube cryocooler, the cold head thereof, and the pulse tube thereof; the temperature sensor for measuring the temperature of the liquefied oxygen; and the control device for controlling the output of the pulse-tube cryocooler according to the temperature measured by the temperature sensor.

The cryocooler cools air to a temperature not higher than the liquefaction temperature of oxygen and not lower than the liquefaction temperature of argon to obtain the liquid oxygen, thereby separating the liquefied oxygen from nitrogen and argon, each in a gas phase, or from argon in a gas phase. Air introduced into the cooling part of the cryocooler exchanges the heat with the low-temperature gas including separated nitrogen and argon. Further, the moisture in the introduced air is removed in advance. Therefore, it is possible to effectively separate oxygen in air from nitrogen and argon, so that the high-purity liquid oxygen with the oxygen concentration of 99.5% or higher can be obtained directly and with high efficiency.

While the invention has been explained with reference to the specific embodiments of the invention, the explanation is illustrative and the invention is limited only by the appended claims.

What is claimed is:

1. A method for producing oxygen, comprising the steps of:

cooling air to a temperature less than a liquefaction temperature of oxygen and higher than a liquefaction temperature of argon with a cryocooler to obtain liquefied oxygen, measuring a temperature of the liquefied oxygen, and controlling an output of the cryocooler to maintain the temperature at a predetermined value, and separating the liquefied oxygen from nitrogen and the argon in gas phases, or from the argon in a gas phase.

2. A method for producing oxygen according to claim 1, further comprising, before the step of cooling the air, conducting at least one of the step of preliminary cooling the air and the step of removing moisture in the air, wherein the air to be introduced to a cooling part of the cryocooler is cooled by a heat exchange with a low-temperature gas including the nitrogen gas and argon gas and separated in the step of separating the oxygen.

3. A method for producing oxygen according to claim 1, further comprising the step of separating the nitrogen in the air with a PSA method to obtain an oxygen-rich gas in advance before introducing the air into a cooling part of the cryocooler.

4. A method of producing oxygen according to claim 1, wherein, in the step of measuring the temperature of the liquefied oxygen, the temperature of the liquefied oxygen is measured via heat-transferal means immersed in the liquefied oxygen.

5. A method for producing oxygen according to claim 1, wherein the cryocooler is a pulse-tube cryocooler.

6. A oxygen-production device for producing oxygen, comprising:

a pulse-tube cryocooler for cooling atmospheric air to liquefy the oxygen, said pulse-tube cryocooler having a heat regenerator, a cold head, and a pulse tube;

a main container for obtaining and retaining liquefied oxygen having an air inlet, an output port for the liquefied oxygen, and an outlet for residual gases other than the liquefied oxygen, said main container retaining the heat regenerator, the cold head and the pulse tube therein;

a temperature sensor for measuring a temperature of the liquefied oxygen; and a control device electrically connected to the temperature sensor for controlling an output of the pulse-tube cryocooler according to the temperature measured by the temperature sensor.

7. An oxygen-production device according to claim 6, wherein said main container includes a liquid storage container for generating the liquid oxygen provided with the temperature sensor therein, and a heat exchanger thermally connected to the cold head, said air introduced into the heat exchanger being cooled and supplied into the liquid storage container, and the liquefied oxygen being separated from nitrogen and argon in gas phases in the liquid storage container.

8. An oxygen-production device according to claim 6, wherein said main container includes a liquid storage container provided with the temperature sensor therein and thermally connected to the cold head, and the liquefied oxygen being separated from nitrogen and argon in gas phases in the liquid storage container.

9. An oxygen-production device according to claim 8, wherein said liquid storage container is provided with a radiator member thermally connected to the cold head.

10. An oxygen-production device according to claim 6, further comprising a heat exchanger for preliminarily cooling the air to be introduced into the container through heat exchange between the air to be introduced and a low-temperature gas including nitrogen and argon which were separated in the main container.

11. An oxygen-production device according to claim 6, further comprising a dehumidifier for removing moisture from the air to be introduced into the main container through coldness of a low-temperature gas including nitrogen and argon which were separated in the container.

12. An oxygen-production device according to claim 11, wherein said dehumidifier includes a main housing having an air introduction pipe; a low-temperature gas pipe with a radiation fin passing through the main housing; and a selector valve arranged below the main housing for switching the air and condensed water.

13. An oxygen-production device according to claim 12, wherein said dehumidifier includes an adsorbent in the main housing for adsorbing moisture therein.

14. An oxygen-production device according to claim 6, further comprising a pair of dehumidifiers provided with air introduction pipes, low-temperature gas introduction/discharge pipes, and selector valves so that when the air is introduced into the main container through one of the humidifiers to liquefy the oxygen, the air flows through the other of the dehumidifiers to discharge condensed water in the main container to outside through the selector valve.

15. An oxygen-production device according to claim 6, further comprising a pair of dehumidifiers provided with air introduction pipes, low-temperature gas introduction/discharge pipes, and selector valves, said dehumidifiers being connected to each other through the low-temperature gas discharge pipes, said air introduction pipes having air selector valves so that condensed water in a main housing of one of the dehumidifiers is discharged together with low-temperature gas discharged from a main housing of the other of the dehumidifiers through one of the selector valves.

* * * * *